US006648670B1

(12) United States Patent
Chen

(10) Patent No.: US 6,648,670 B1
(45) Date of Patent: Nov. 18, 2003

(54) DUAL-HEAD IDC TERMINAL

(75) Inventor: Michael Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 10/209,274

(22) Filed: Aug. 1, 2002

(51) Int. Cl.[7] ..... H01R 4/24
(52) U.S. Cl. ..... 439/404
(58) Field of Search ..... 439/404, 405

(56) References Cited

U.S. PATENT DOCUMENTS 4,381,132 A * 4/1983 Tournier ..... 439/405
6,126,476 A * 10/2000 Viklund et al. ..... 439/404
6,193,526 B1 * 2/2001 Milner et al. ..... 439/404
6,238,231 B1 * 5/2001 Chapman et al. ..... 439/404
6,280,231 B1 * 8/2001 Nicholls ..... 439/404

* cited by examiner

*Primary Examiner*—Gary Paumen
(74) *Attorney, Agent, or Firm*—Birch, Stewart, Kolasch & Birch, LLP

(57) ABSTRACT

A dual-head IDC terminal has the design of different intervals such that the interval of the IDC terminals of the same pair is smaller than the distance between two neighboring IDC terminals. The IDC terminal is installed in a biased fashion and has an extension flap to increase the compensation effect for the IDC terminals of different pairs but with the same line position attributes, thereby to conform to the EIA/TIA Category 6 standards. The structure is simple and the size is compact, and may be assembled without using special wiring machines.

9 Claims, 7 Drawing Sheets

DUAL-HEAD IDC TERMINAL

FIELD OF THE INVENTION

The invention relates to a dual-head Insulation Displacement Connection (IDC) terminal for transmitting high-speed electronic signals, and particularly an IDC terminal that conforms to EIA/TIA Category 6 standards and has a simple structure and compact size.

BACKGROUND OF THE INVENTION

In recent years networks communication systems have become very popular for transmitting data. Network communication systems require high transmission efficiency. This not only demands high quality connection lines, but also requires high quality connectors, especially when the transmission speed becomes faster. In general, the actual network communication paths consist of transmission media and transmission connectors. The transmission media include Twisted Pairs, Coaxial Cables, Optical Fibers, etc. However, the network communication paths mentioned above still have drawbacks. As a result, signal quality deteriorates as the frequency of network communication systems increases. For instance:

1. Near-End Cross Talk (NEXT) phenomenon: when two cables are close to each other and generate induction, interference occurs due to electromagnetism and the Cross Talk phenomenon is produced.
2. Impedance: the impedance of the transmission media must match the system to effectively transmit signals.
3. Return Loss: as the impedance of transmission systems is not continuous, reflections are generated and result in power loss.
4. Attenuation: when signals are transmitted through the transmission media, signal intensity and power attenuate with the signal travelling distance.

The standards announced by Electronic Industries Association (EIA) and TIA have been adopted by IEEE. Hence EIA/TIA 568 standards have been included in 802.3u standards. Every transmission medium and connector is required to conform to these standards. Those that have conformed to the standards are classified. At present, Category 6 standards have become a basic requirement. Therefore, it is necessary to target some of the problems that still exist to develop improved solutions.

Conventional dual-IDC terminals, as shown in FIG. 1, include terminals 11 which are mounted parallel to the longitudinal axis of the terminal seat 12. Every IDC terminal 11 is equally spaced from one another. Hence every pair of IDC terminals 11 is affected by the interference of neighboring terminals. Transmission quality thus becomes very poor. In order to resolve this problem, some techniques have been proposed in the prior art. For instance, Siemon Co. suggests using metal shielding. As shown in FIG. 2A, the intervals between four pairs of IDC terminals 11 are increased, and each pair of the IDC terminals 11 is guarded by a shield blade 13. Through the interactions between the shield blade 13 of two pairs of neighboring IDC terminals 11, interference is reduced. However, the total size of the IDC terminals has to be greatly increased. Material and production costs also increase. Panduit Co. proposes a technique that mounts a pair of IDC terminals 11 in two rows in a staggered fashion. The intervals of any three neighboring IDC terminals 11 are about the same. While such a design enables any two neighboring IDC terminals 11 to obtain the TT compensation effect as shown in FIG. 2B, the thickness T of the total IDC terminal set increases. As a result, a general wiring machine cannot be used to install the communication core lines.

SUMMARY OF THE INVENTION

The primary object of the invention is to provide a dual-head IDC terminal that is installable by a general wiring machine and able to enhance bonding of the terminal seat and the IDC terminal, in order to increase the compensating effect and improve transmission quality.

The dual-head IDC terminal of the invention includes a plurality of IDC terminal pairs and a terminal seat. The IDC terminal is formed in a dual-head fashion with the IDC ends located on two ends thereof. The terminal seat has a plurality of insert slots to install the IDC terminals. Each pair of the IDC terminals has a smaller interval. In other words, the distance between the terminals in each pair of IDC terminals is smaller than the distance from a certain pair of IDC terminal to the neighboring pairs of IDC terminals. Hence a compensation effect is generated in each pair of IDC terminals. Meanwhile, the IDC terminal may be installed in the terminal seat in a biased manner such that the terminals of the same pair are closer to each other to keep the thickness of the whole IDC terminal set the same. Moreover, communication core lines may be installed by a general wiring machine. There is an extension flap located proximately in the middle portion of the IDC terminal. The extension flap of one pair of IDC terminals is extended outwards towards another IDC terminal so that different pairs of IDC terminals of the same attributes are close to each other to enhance the compensation effect and improve the effectiveness.

Moreover, the extension flap may be designed and mounted substantially parallel to the longitudinal axis of the terminal seat. The extension flap also may have an anchor hole and the IDC terminal may be anchored by a cover plate to increase the fastening strength and facilitate assembly.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
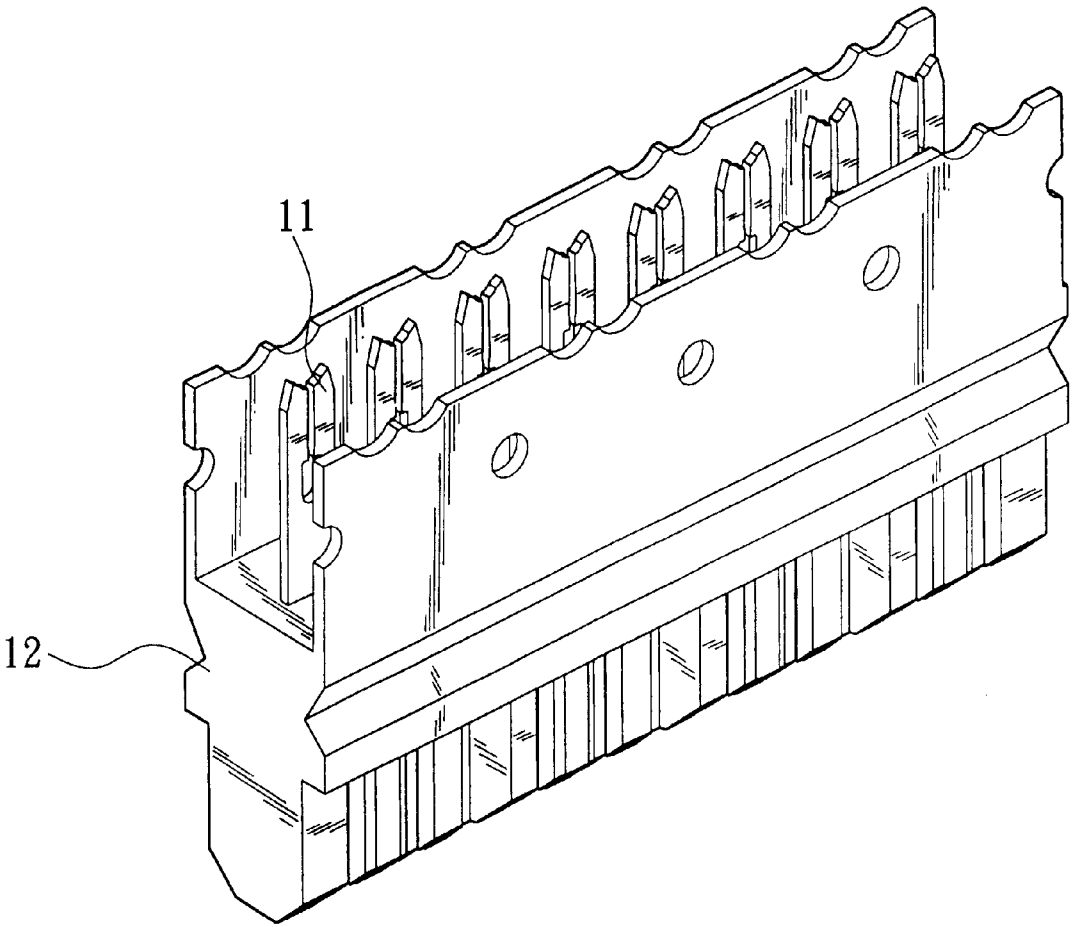
FIG. 1 (PRIOR ART)
FIG. 1 is a schematic view of a conventional IDC terminal.
Figure 2A:
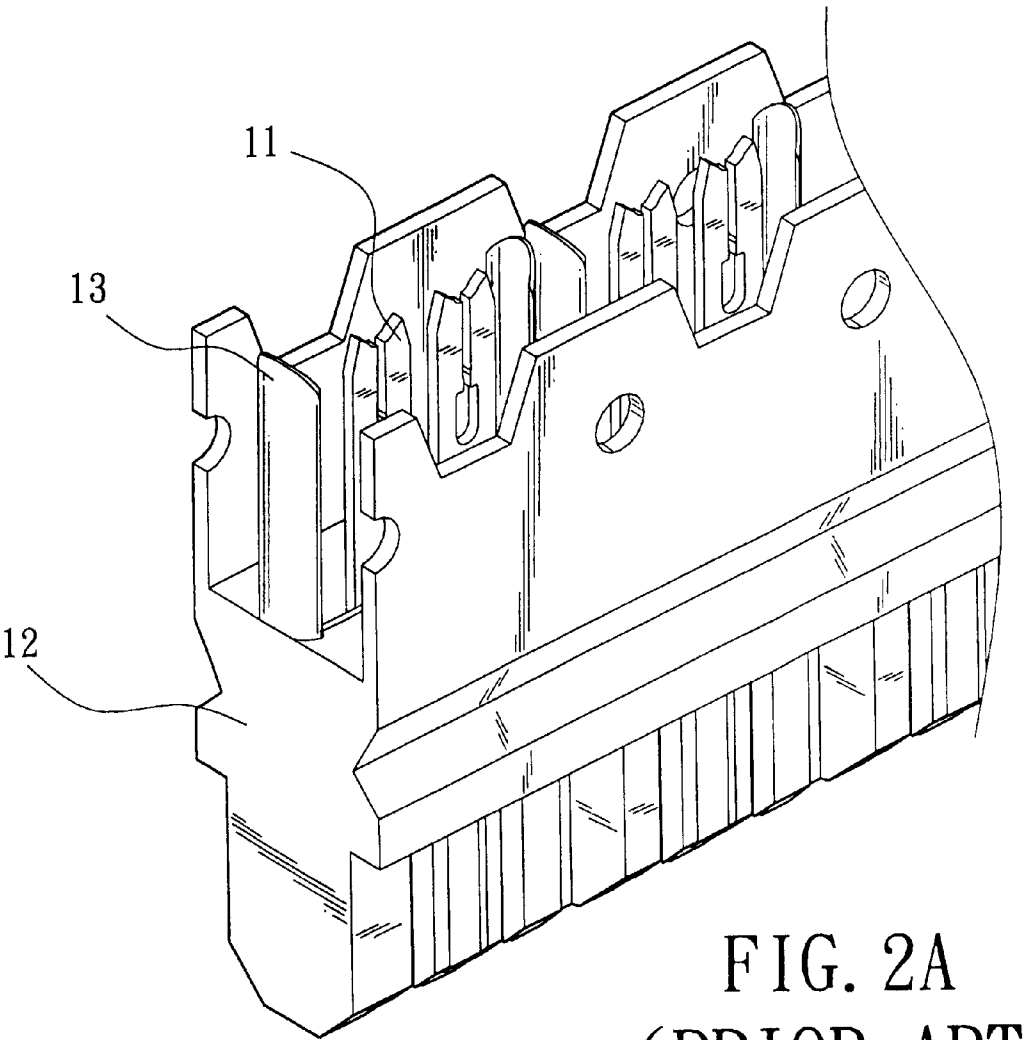
FIG. 2A (PRIOR ART)
FIGS. 2A and 2B are schematic views of IDC terminals disclosed in the prior art.
Figure 2B:
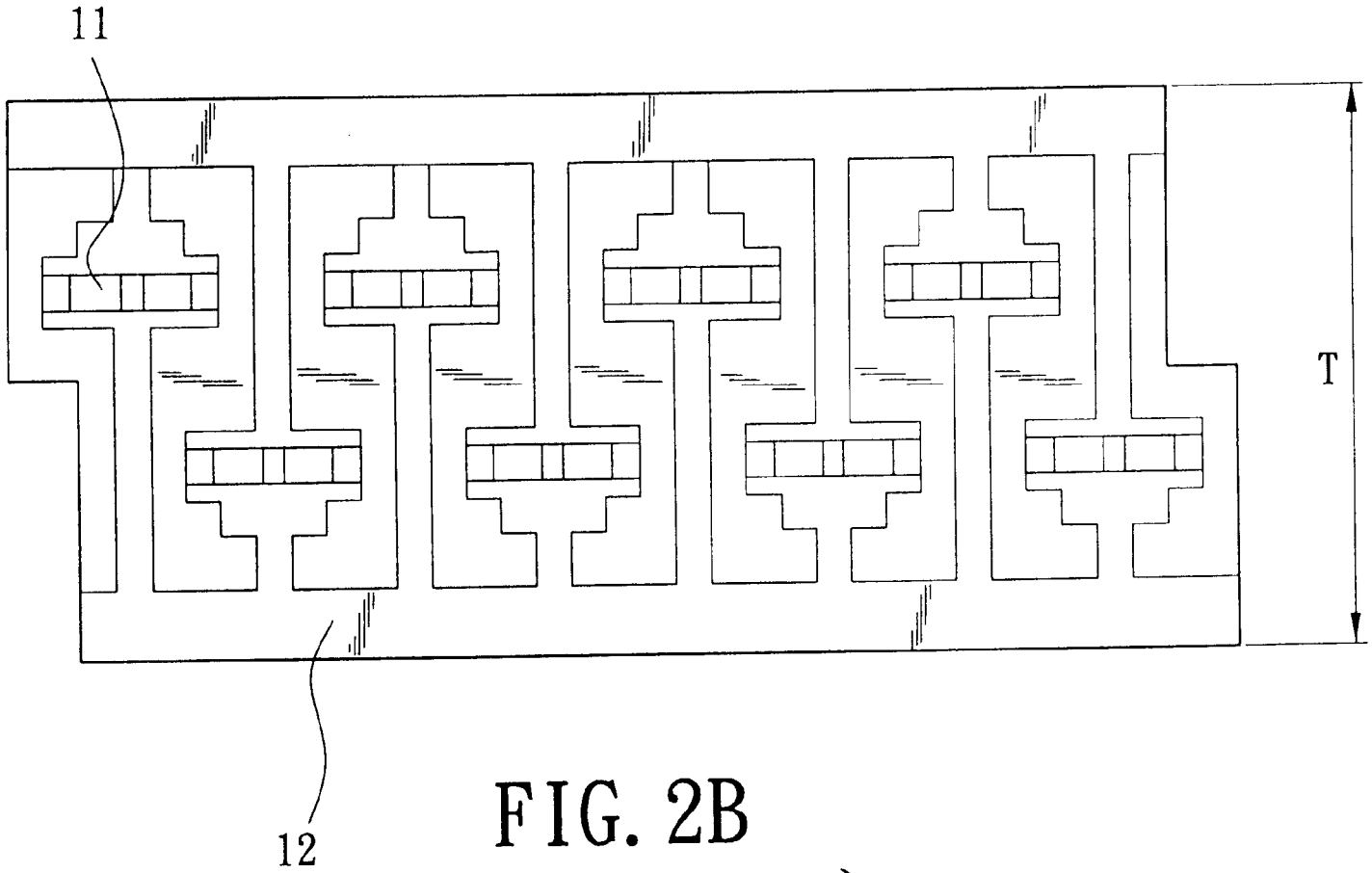
FIG. 2B (PRIOR ART)
Figure 3:
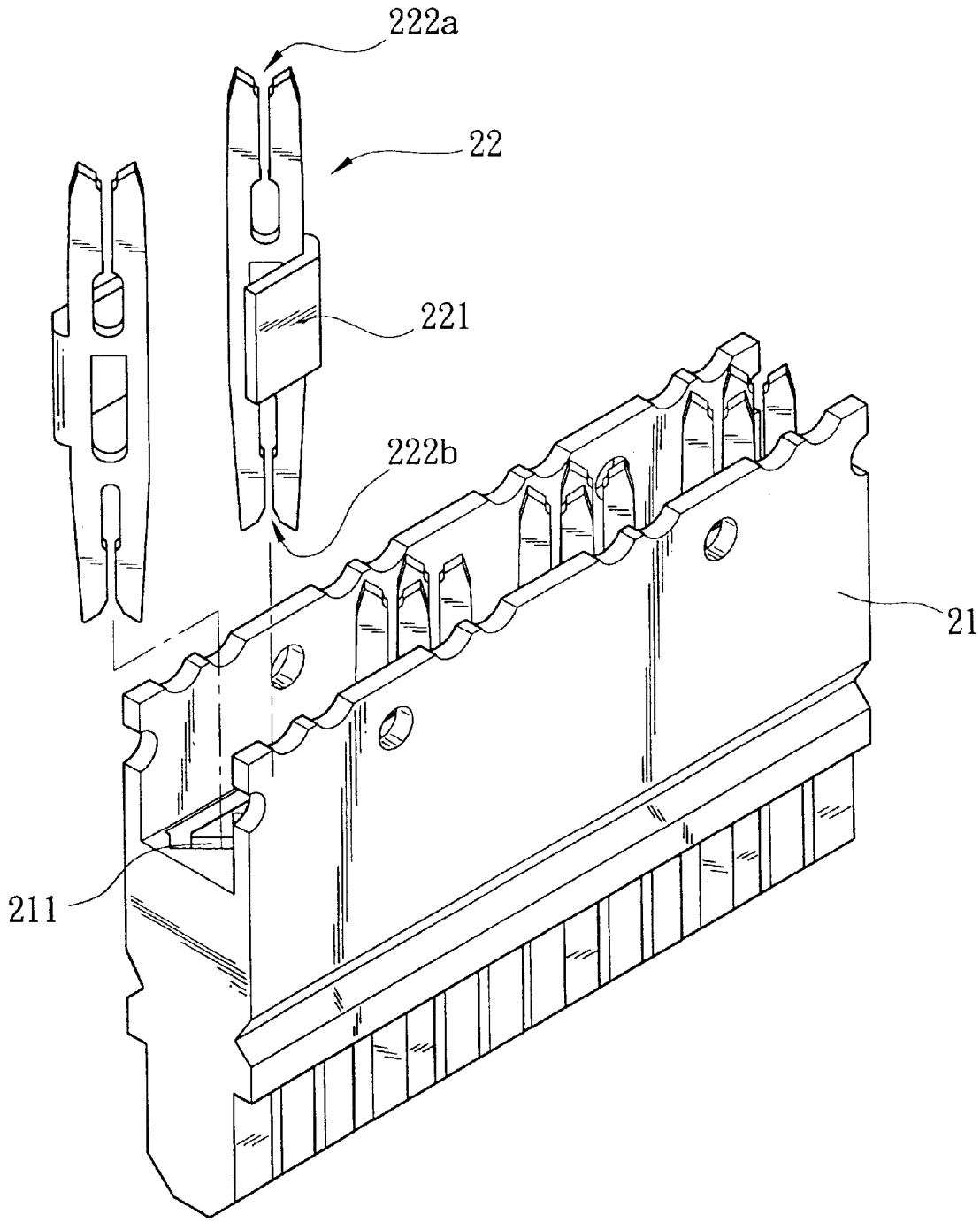
FIG. 3 is a schematic view of the invention.

Referring to FIG. 3, the dual-head IDC terminal of the invention includes a terminal seat 21 and a plurality of IDC terminals 22, which in general are four pairs. Hence four pairs of IDC terminals 22 are shown in the drawing as an example for description. The terminal seat 21 has a plurality of insert slots 211 corresponding to the IDC terminals 22 for their installation. The design of the insert slots 211 is such that the interval of the insert slots 211 of the same pair is smaller than the distance to the two neighboring pairs of insert slots 211. In addition, the IDC terminal 22 has two ends forming IDC ends 222*a* and 222*b*. Close to the middle portion of the IDC terminal 22 there is an extension flap 221. When the IDC terminals 22 are installed in the insert slots 211 of the terminal seat 21, the extension flap 211 of the same pair of IDC terminals 22 is extended outwards towards another IDC terminal 22.

Figure 4:
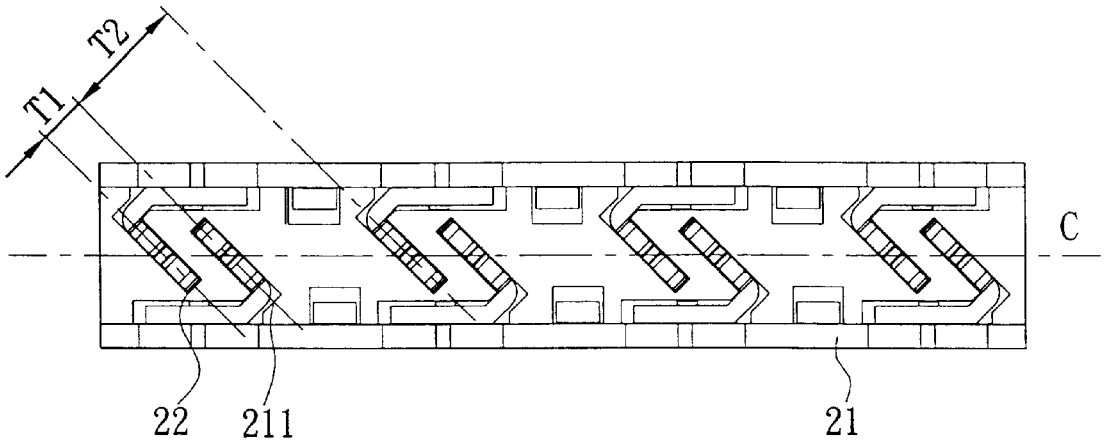
FIG. 4 is a top view of the IDC terminal of the invention.

In general, the IDC terminals 22 have different line position attributes, depending on their installation locations. As shown in FIG. 4, from left to right by sequence, there are the IDC terminals 22 of the first pair to the fourth pair. Each pair of the IDC terminals 22 has a T and R line position (tip, ring). Hence the installation is according to the sequence of TR, TR. As the interval of different line positions generates interference, when the IDC terminals (TR) of the same pair are close to each other, the return loss decreases. Hence through arranging TT and RR of the IDC terminals of the same line position attributes on different pairs, the TR effect may be offset to reduce the cross talk. Hence in the invention, the design of the insert slots 211 of the terminal seat 21 enables the interval T1 of the same pair of IDC terminals 22 be smaller than the distance T2 from a certain pair of IDC terminal to the neighboring pairs of IDC terminals 22. As a result, the capacitance effect between the IDC terminals 22 of the same pair may increase and generate a TR compensation effect. Moreover, the design of the extension flap 221 may decrease the distance D between the IDC terminals 22 with the same line attributes of the neighboring IDC terminals 22. Thus the inductance effect may increase to further enhance the compensation of the TT effect (or the RR effect).

Figure 5:
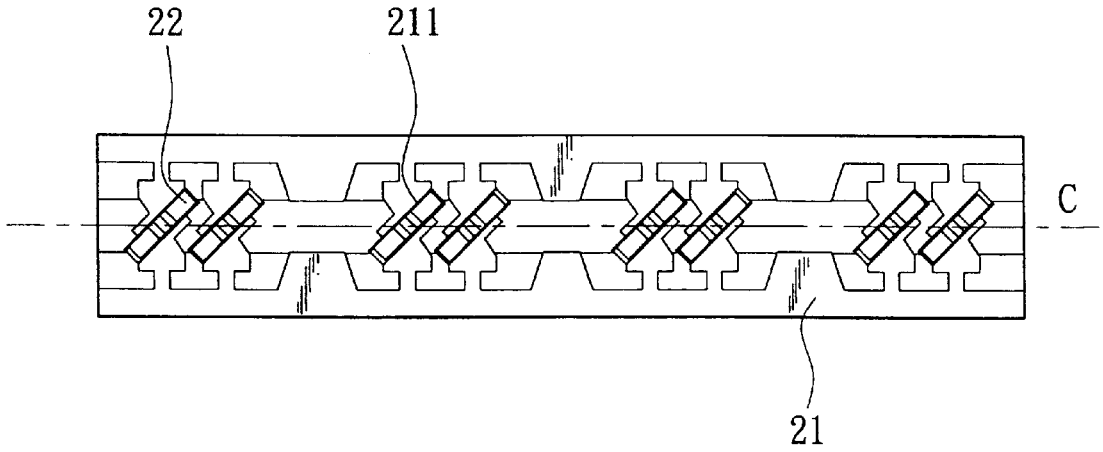
FIG. 5 is a bottom view of the IDC terminal of the invention.

Referring to FIG. 5, the IDC terminal 22 is designed for inserting in a biased manner such that the IDC terminal 22 is not parallel to the longitudinal axis C of the terminal seat 21, but forms an acute angle. Hence the width of the terminal seat 21 may be greatly reduced and the thickness remains unchanged. Therefore, a general wiring machine can be used to install the communication core lines on the IDC terminal in contrast to the prior art, which requires special wiring machines for installation. In addition, the biased installation design enables the IDC terminal 22 to form an acute angle with the longitudinal axis C of the terminal seat 21, and makes installation of the communication core lines more convenient.

Figure 6:
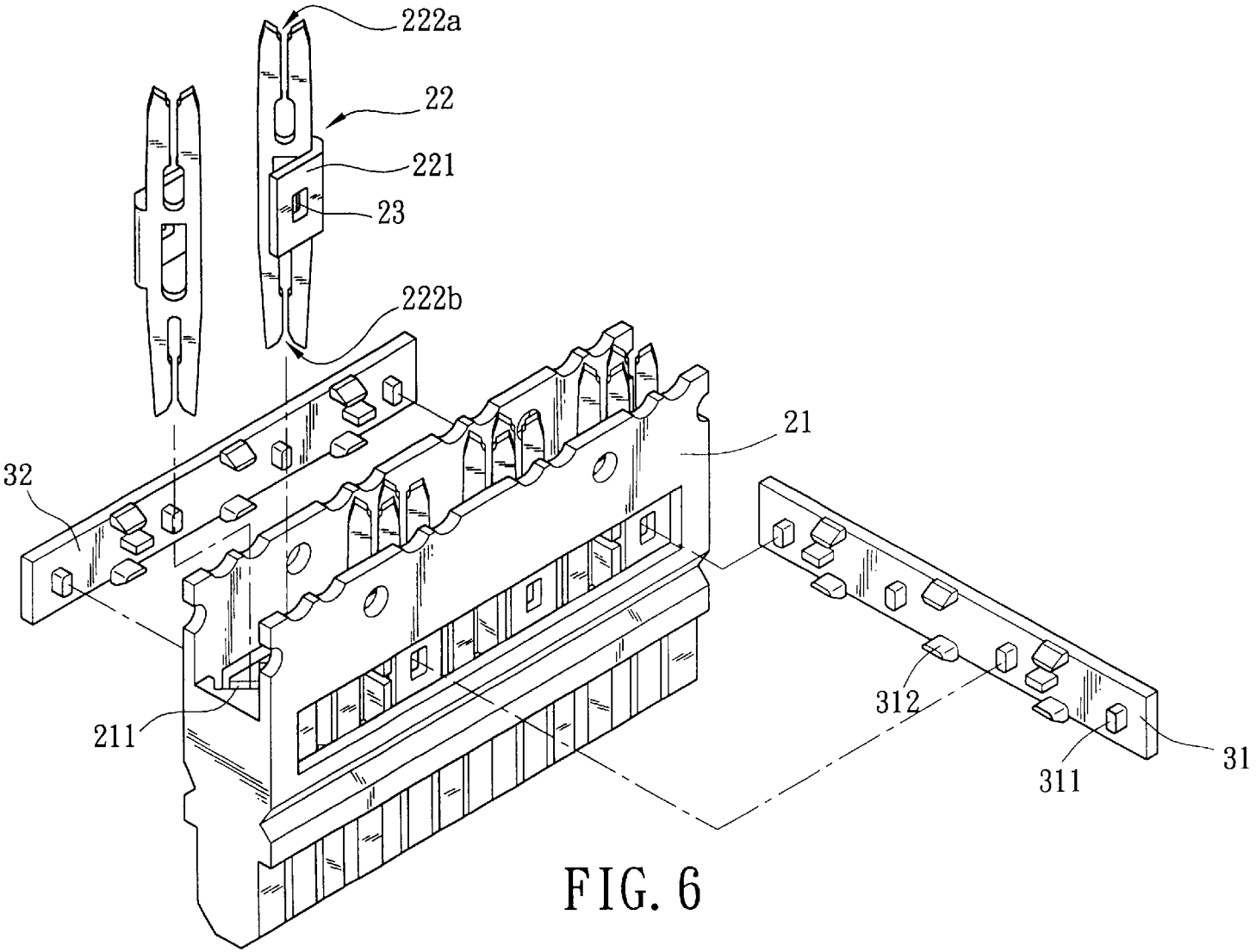
FIG. 6 is a schematic view of the invention, including cover plates.
Figure 7:
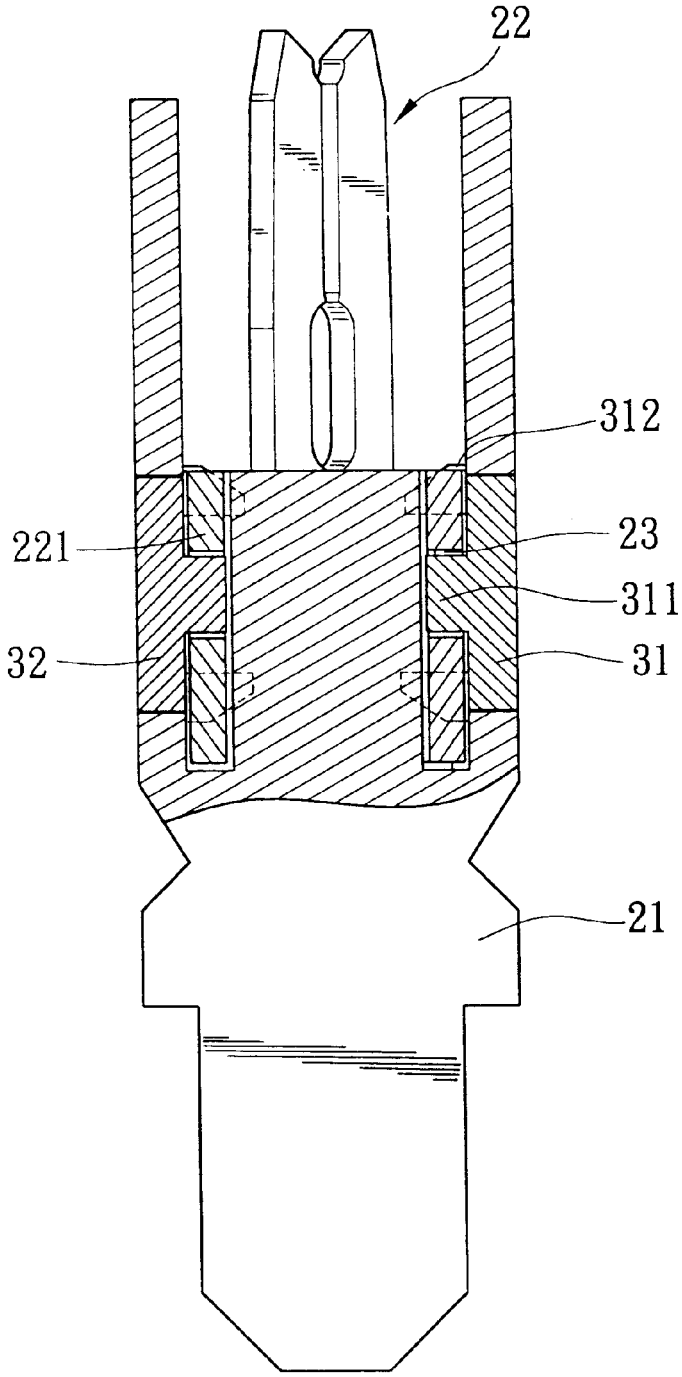
FIG. 7 is a schematic view of the invention, assembled on a terminal seat with cover plates.

Furthermore, the extension flap 221 of the IDC terminal 22 is substantially parallel to the longitudinal axis C of the terminal seat 21, and is extended outwards along two side walls of the terminal seat 21 in the direction of the longitudinal axis C in an alternate up and down fashion. The extension flap 221 may also have an anchor hole 23 to engage with an anchor pin 311 located on a pair of cover plates 31 and 32 as shown in FIGS. 6 and 7. The cover plates 31 and 32 have respectively latch hooks 312 formed on their peripheral edges to latch on the terminal seat 21 to anchor the IDC terminal 22 so that the IDC terminal 22 may be mounted on the terminal seat 21 securely. Such a design also makes installation easier.

In summary, the dual-head IDC terminal of the invention adopts the biased insertion design, thus enabling the IDC terminal to form an acute angle with the longitudinal axis of the terminal seat. In addition, the interval of the IDC terminals of the same pair may be reduced while the distance between two neighboring IDC terminals of different pairs increases. Hence the compensation effect may increase and result in improved communication quality. The design of the extension flap enables the IDC terminals of different pairs with the same line position attributes to be close to each other in order to n compensate for the inductance effect and further improve the transmission quality. Moreover, the extension flap is substantially parallel to the longitudinal axis of the terminal seat and has an anchor hole to engage with the cover plate to enhance the fastening of the IDC terminals.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A dual-head IDC terminal, comprising:

a terminal seat having a plurality of insert slot pairs which form an acute angle with the direction of the longitudinal axis of the terminal seat, each pair of the insert slots having an interval smaller than the distance between two neighboring insert slots of different pairs; and a plurality of IDC terminal pairs having two ends which each form an IDC end, and an extension flap located proximately to a middle portion of each terminal and extended towards the other IDC terminal of the pair, the IDC terminals being inserted in the insert slots and being close to a IDC terminal of a neighboring pair of same line position attributes through the extension flap.

2. The dual-head IDC terminal of claim 1, wherein the extension flap of the IDC terminal is substantially in parallel with the direction of the longitudinal axis of the terminal seat.

3. The dual-head IDC terminal of claim 2, wherein the extension flap has an anchor hole.

4. The dual-head IDC terminal of claim 3 further including a cover plate which has a plurality of anchor pins to engage with the anchor hole of the extension flap to fasten the IDC terminal to the terminal seat.

5. The dual-head IDC terminal of claim 2, wherein the extension flaps of the same pair of the IDC terminals extends outwards along two side walls of the terminal seat in the direction of the longitudinal axis of the terminal seat.

6. The dual-head IDC terminal of claim 5, wherein the extension flap of each IDC terminal has an anchor hole.

7. The dual-head IDC terminal of claim 6 further including a cover plate which has a plurality of anchor pins to mount on two side walls of the terminal seat in the longitudinal axis direction thereof and to run through the terminal seat to engage with the anchor holes to fasten the IDC terminals to the terminal seat.

8. The dual-head IDC terminal of claim 1, wherein each pair of the IDC terminals have an equal interval.

9. The dual-head IDC terminal of claim 1, wherein each IDC terminal is in parallel with each other.

* * * * *